US007721634B2

(12) United States Patent
Komiya

(10) Patent No.: US 7,721,634 B2
(45) Date of Patent: May 25, 2010

(54) PUNCH TOOL

(75) Inventor: Hidenori Komiya, Kanagawa (JP)

(73) Assignee: Amada Company, Limited, Isehara-Shi (JP)

( * ) Notice: Subject to any disclaimer, the term of this patent is extended or adjusted under 35 U.S.C. 154(b) by 447 days.

(21) Appl. No.: 11/570,933

(22) PCT Filed: Jun. 23, 2005

(86) PCT No.: PCT/JP2005/011528

§ 371 (c)(1),
(2), (4) Date: Dec. 19, 2006

(87) PCT Pub. No.: WO2006/001329

PCT Pub. Date: Jan. 5, 2006

(65) Prior Publication Data

US 2008/0276783 A1 Nov. 13, 2008

(30) Foreign Application Priority Data

Jun. 25, 2004 (JP) ..... 2004-187880

(51) Int. Cl.
*B26F 1/04* (2006.01)

(52) U.S. Cl. ..... 83/552; 83/588; 83/687

(58) Field of Classification Search ..... 83/552, 83/687, 691, 588
See application file for complete search history.

(56) References Cited

U.S. PATENT DOCUMENTS 4,250,785 A * 2/1981 Morishita et al. ..... 83/552
4,412,469 A * 11/1983 Hirata et al. ..... 83/552
5,076,127 A * 12/1991 Otto et al. ..... 83/552
5,119,666 A 6/1992 Fujiwara
5,848,563 A 12/1998 Saito
6,109,159 A * 8/2000 Seto ..... 83/699.31

FOREIGN PATENT DOCUMENTS

| | | |
|---|---|---|
| JP | 3-8524 | 1/1991 |
| JP | 6-198540 | 7/1994 |
| JP | 8-103833 | 4/1996 |
| JP | 8-155561 | 6/1996 |
| JP | 8-206748 | 8/1996 |
| JP | 3065751 | 11/1999 |

OTHER PUBLICATIONS

English language Abstract of JP 8-206748.
English language Abstract of JP 3-8524.
English language Abstract of JP 6-198540.
English language Abstract of JP 8-103833.
English language Abstract of JP 8-155561.

* cited by examiner

*Primary Examiner*—Kenneth E. Peterson
(74) *Attorney, Agent, or Firm*—Greenblum & Bernstein P.L.C.

(57) ABSTRACT

A punch tool includes a casing; a plurality of small-diameter punches vertically movable and circularly arranged in the casing; a plurality of large-diameter punches vertically movable and circularly arranged in the casing; a punch driver provided to be vertically movable and relatively rotatable on an upper portion of the casing; and a striker provided on the punch driver to be capable of striking the respective punches. Stripper springs corresponding to the respective small-diameter punches are provided. Since the respective large-diameter punches are arranged between the small-diameter punches, the stripper springs for the small-diameter punches on both sides of the large-diameter punch serve as stripper springs of the large-diameter punch.

2 Claims, 4 Drawing Sheets

(A)

(B)

PUNCH TOOL

TECHNICAL FIELD

The present invention relates to a punch tool including a plurality of punches circularly arranged in a casing, and, particularly to a punch tool where an eccentric load does not act when a punch is drawn out of a workpiece after punching work, and more punches can be arranged.

BACKGROUND ART

A punch tool including a plurality of punches circularly arranged has a configuration in which a plurality of punches are circularly arranged in a casing attachable to and detachable from a rotating holder mounted on a punch holder rotatably in a punch press, and a striker capable of freely striking each punch is provided to be vertically movable in the upper portion of the casing. An example of a corresponding prior technique is disclosed in Japanese Patent Application Laid-open No. H8-155561.

In a configuration described in the above patent publication, a plurality of punches are supported to be vertically movable in a punch mounting portion in the casing, and a head portion of each punch is engaged with a peripheral groove having a cross-sectional shape of a T-shape formed on a striking plate corresponding to the striker. When punching work is performed on a workpiece by each punch, a stripping force for drawing the punch from the workpiece acts on a central portion of the striking plate.

Therefore, when the punch is drawn out of the workpiece, an unbalanced load acts on the punch and a bending moment acts thereon, which can cause a jamming phenomenon on a slide guiding portion, such as a sliding portion of the punch or the striking plate. In the configuration of the Patent Document 1, an elastic member is arranged opposite to the center of the lower face of the striking plate. Therefore, a problem arises that it is difficult to doubly arrange a plurality of punches along an inside circle and an outside circle, so that it is difficult to arrange more punches.

The present invention has been achieved to solve the above problems, and an object of the present invention is to provide a punch tool where an unbalanced load does not act when a punch is drawn out of a workpiece after punching work, and more punches can be arranged.

DISCLOSURE OF THE INVENTION

To achieve the above object, a punch tool based on a first aspect of the present invention includes the following: a casing; a plurality of small-diameter punches vertically movable and circularly arranged in the casing; a plurality of large-diameter punches vertically movable and circularly arranged in the casing; a punch driver provided to be vertically movable and relatively rotatable on an upper portion of the casing; and a striker provided on the punch driver to be capable of striking the respective punches; wherein, in the configuration, stripper springs corresponding to the respective small-diameter punches are provided; and the respective large-diameter punches are arranged between the small-diameter punches; and, by the configuration, the stripper springs for the small-diameter punches on both sides of the large-diameter punch act as stripper springs of the large-diameter punch.

A punch tool based on a second aspect of the present invention includes the following: a casing; a plurality of punches circularly arranged to be vertically movable in the casing; a punch driver provided to be vertically movable and relatively rotatable on an upper portion of the casing; and a striker provided on the punch driver to be capable of striking the respective punches; where the plurality of punches are arranged on a large-diameter circle outside the casing; the plurality of punches are arranged on a small diameter circle inside the casing; and the punches on the outside circle, and the punches on the inside circle are arranged at positions different in phase.

According to a punch tool based on a third aspect of the present invention, which is dependent on the first aspect or the second aspect, in the above punch tool, small-diameter punches and large-diameter punches are arranged alternately at approximately equal intervals on the outside circle; and medium-diameter punches are arranged on the inside circle.

According to a punch tool based on a fourth aspect of the present invention, which is dependent on any one of the first aspect to the third aspect, in the above punch tool, stripper springs provided correspondingly to the respective small-diameter punches serve as stripper springs of the large-diameter punches and medium-diameter punches.

According to a punch tool based on a fifth aspect of the present invention, which is dependent on any one of the first aspect to the fourth aspect, in the above punch tool, a retainer is provided on the small-diameter punch; another retainer is provided on the large-diameter punch; and a seat portion that supports the retainer provided on the large-diameter punch adjacent to the small-diameter punch is provided on the retainer provided on the small diameter punch.

According to a punch tool based on a sixth aspect of the present invention, which is dependent on any one of the first aspect to the fifth aspect, in the above punch tool, striking-force transmitting members for transmitting a striking force of the strikers to the respective punches is provided to be vertically movable on the upper portions of the respective punches.

According to a punch tool based on a seventh aspect of the present invention, which is dependent on any one of the first aspect to the sixth aspect, in the above punch tool, a striker portion corresponding to a position where the punch on the outside circle is struck and a striker portion corresponding to a position where the punch on the inside circle is struck are provided on the striker.

Therefore, according to the punch tool based on the present invention, since a force, at a time of drawing the punch from the workpiece after punching work to the workpiece is performed by the punch, acts in a direction parallel with the axial center of the punch, a force tending to bend the punch does not act, and a bending moment that acts on the punch does not occur, so that a jamming phenomenon can be eliminated.

Since the punches can be doubly arranged along the inside circle and the outside circle, more punches can be provided.

BEST MODE(S) FOR CARRYING OUT THE INVENTION

Preferred embodiments of the present invention will be explained with reference to FIG. 1 to FIG. 4.

Figure 1:
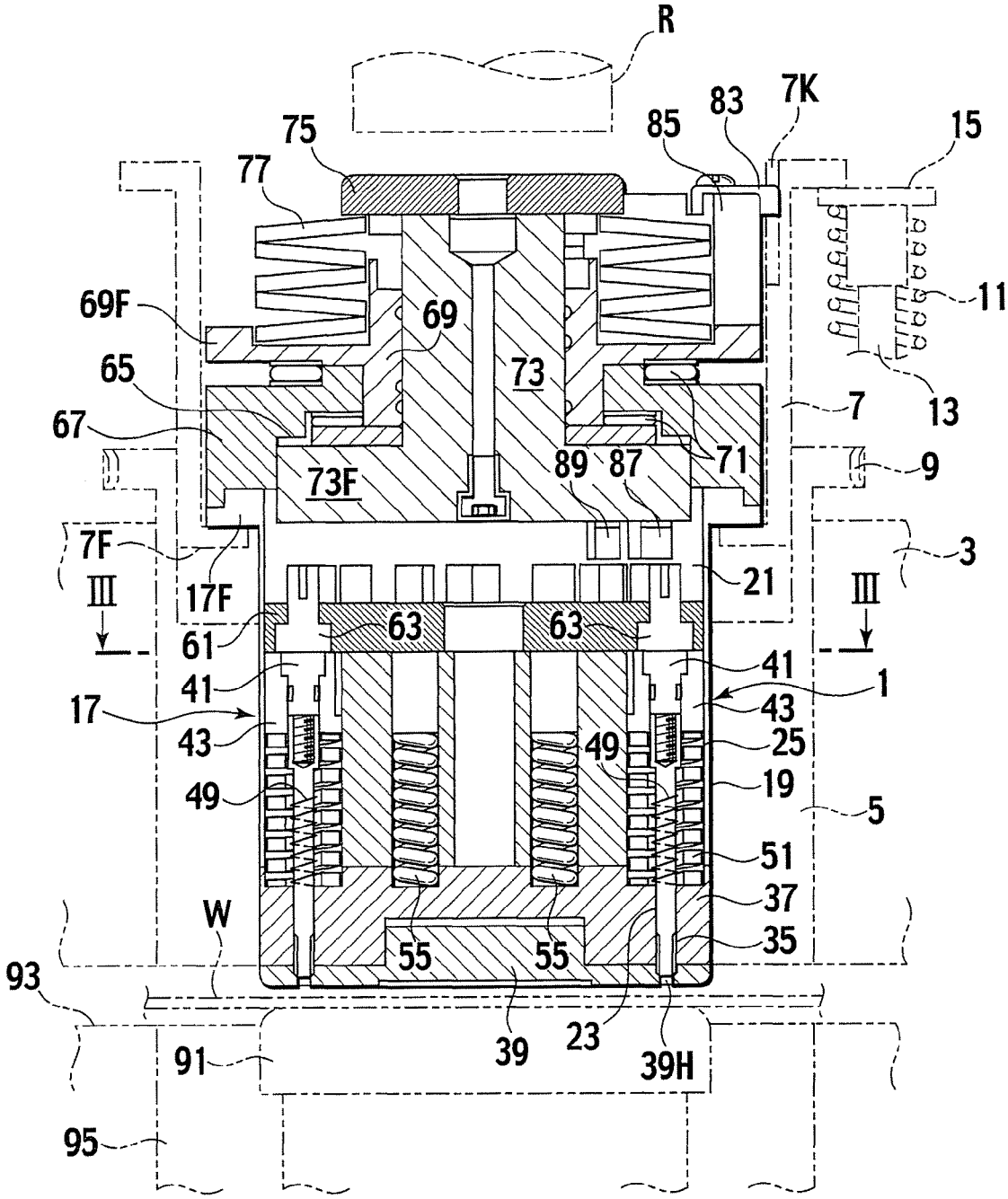
FIG. 1 is an explanatory sectional view of a punch tool according to an embodiment of the present invention.
Figure 2:
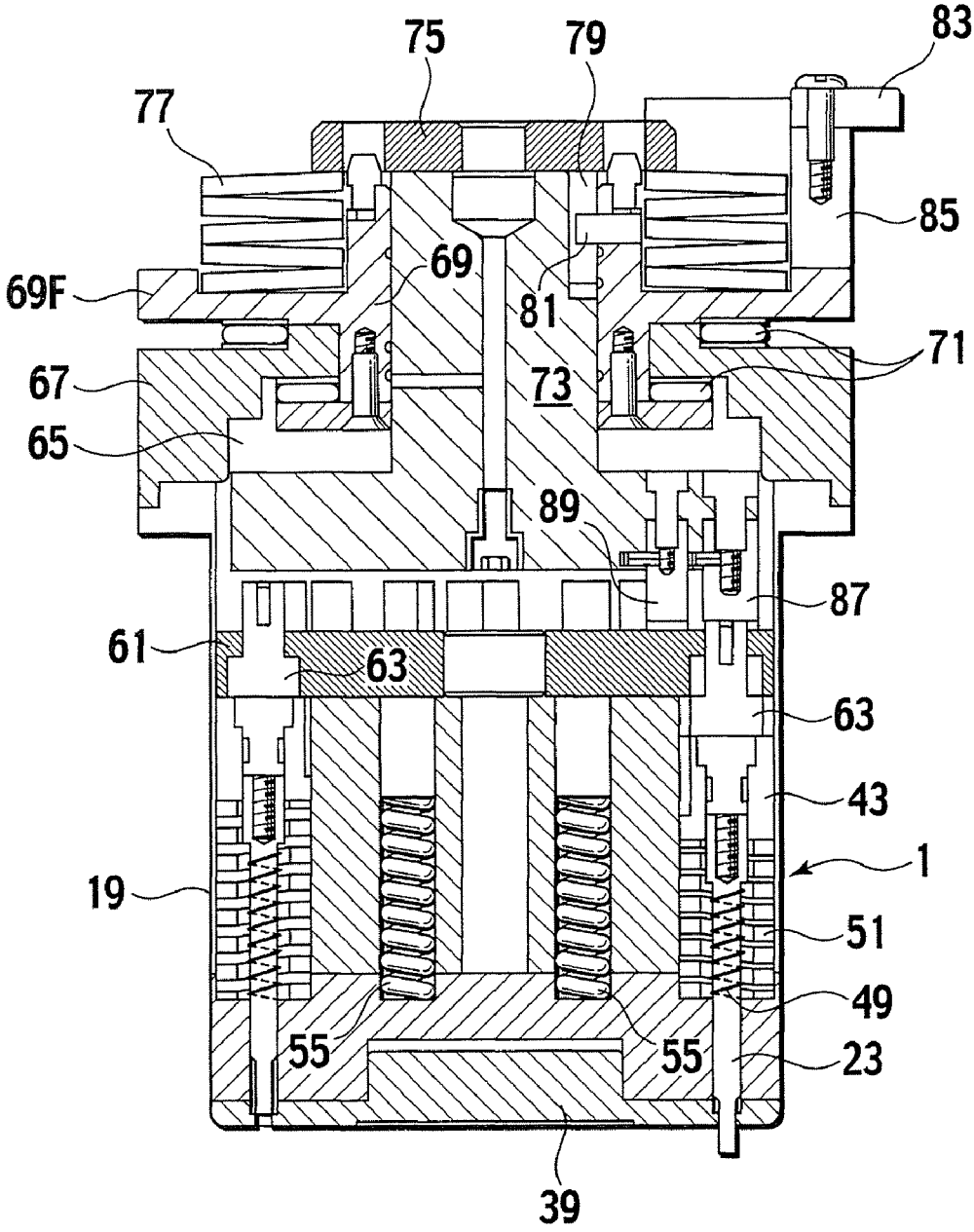
FIG. 2 is an explanatory sectional view showing an operating state of the punch tool according to the embodiment of the present invention.

First, with reference to FIG. 1, a punch tool 1 according to an embodiment of the present invention is mounted on a punch holder 3 in a punch press such as a turret punch press to be used. More specifically, a cylindrical rotating holder 5 is rotatably supported in the punch holder 3, and a cylindrical lifter ring 7 whose lower end portion is fitted in the rotating holder 5 is supported at an upper position of the rotating holder 5, to be vertically movable and relatively rotatable.

In order to rotate the rotating holder 5, a worm wheel 9 is provided at the upper portion of the rotating holder 5, and the worm wheel 9 meshes with a worm (not shown), which is controlled and rotated by a servomotor (not shown). Therefore, the rotating holder 5 can be rotated by the servomotor.

The lifter ring 7 is supported at a predetermined height position by lifter springs 11 provided at a plurality of portions on the upper face of the punch holder 3. That is, spring seats 15 are supported to be vertically movable on bolts 13 erectly provided at a plurality of portions on the upper face of the punch holder 3, and the lifter springs 11 are resiliently mounted between the spring seats 15 and the upper face of the punch holder 3. The lifter spring 7 is supported by the spring seats 15 at the plurality of portions. The lifter ring 7 is supported so as not to rotate with respect to the rotating holder 5, namely, so as to make it unrotatable.

Since the configuration according to the rotating holder 5, the lifter ring 7 and the like is a known configuration from the patent document and the like, more detailed explanations regarding the rotating holder 5, the lifter ring 7 and the like will be omitted.

A casing 17 constituting the punch tool 1 is supported to be vertically movable in the cylindrical rotating holder 5. More specifically, a flange 17F is provided at the upper portion of the casing 17, and the flange 17F is supported on an inner flange 7F provided on a lower end portion of the lifter ring 7. That is, the casing 17 is supported to move vertically and integrally with the lifter ring 7, and the lifter spring 11 has a function of causing the punch tool 1 and the like to ascend and return to the most ascended position.

The casing 17 is supported to be vertically movable with respect to the rotating holder 5 and to rotate integrally with the rotating holder 5 via a key (not shown), and a plurality of punches are provided to be vertically movable in the casing 17. More specifically, a thick punch mounting portion 19 (see FIG. 3) is provided so as to extend in a vertical direction in the casing 17, and a circular recess upper space 21 is formed on an upper side of the punch mounting portion 19.

Punch mounting holes are provided on a large-diameter outside circle L1 (see FIG. 3) and a small-diameter inside circle L2 on the punch mounting portion 19, respectively. Punch mounting holes 25 for a small-diameter punch 23 and punch mounting holes 29 for a large-diameter punch 27 are provided alternately at approximately equal intervals on the outside circle L1. Punch mounting holes 33 for a medium-diameter punch 31 are provided on the inside circle L2.

The center position of the punch mounting hole 33 for the medium-diameter punch 31 is arranged at a position where a phase is deviated with respect to the centers of the respective punch mounting holes 25 and 29 of the small-diameter punch 23 and the large-diameter punch 27. In other words, the small-diameter punch 23, the medium-diameter punch 31, and the large-diameter punch 27 are arranged in a zig-zag manner, namely, in a staggering manner.

A disk-like guide member 37 including punch guide holes 35 that guide the small-diameter punches 23, the medium-diameter punches 31, and the large-diameter punches 27 to be vertically movable is detachably attached by a plurality of bolts (not shown) on a lower portion of the punch mounting portion 19 in the casing 17, and a stripper plate 39 including guiding holes 39H that guide punch blade portions of the respective punches 23, 27, and 31 is detachably attached on a lower face of the guide member 37 by a plurality of screws (not shown) so as to be replaceable.

As shown in FIG. 1, a punch head 41 is screwed and fixed integrally on an upper portion of the small-diameter punch 23, and a retainer 43 is fitted and supported to be vertically movable thereon. A fitting hole 45 (see FIG. 4(A)) capable of freely fitting the punch head 41 is provided on the retainer 43, and the fitting hole 45 is vertically movable with respect to the punch head 41. A locking step portion 45A (see FIG. 4(B)) capable of freely locking the punch head 41 is then formed on the fitting hole 45 in order that the retainer 43 descends integrally when the punch head 41 descends.

Figure 3:
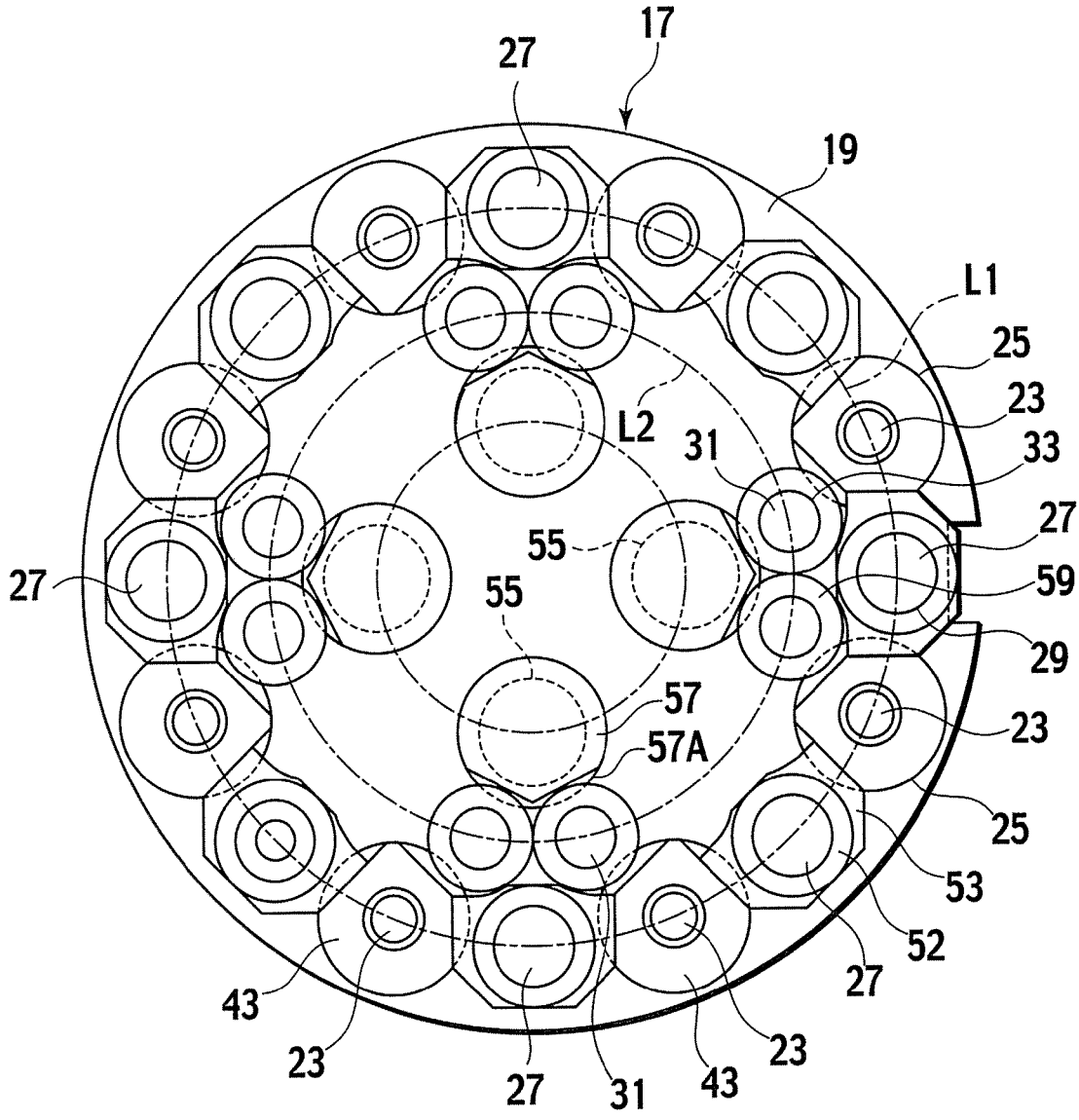
FIG. 3 is an explanatory sectional view taken along the line III-III in FIG. 1.
Figure 4:
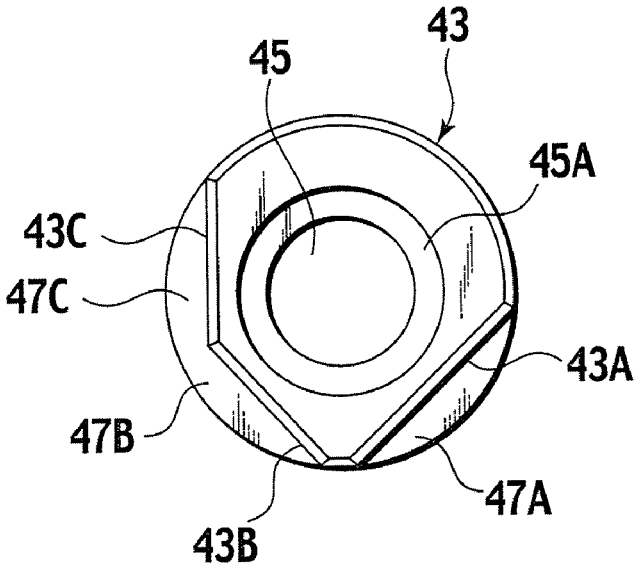
FIG. 4(A) is a plan view showing a configuration of a retainer provided on a small-diameter punch.
FIG. 4(B) is a side view showing the configuration of the retainer.
Figure 4:
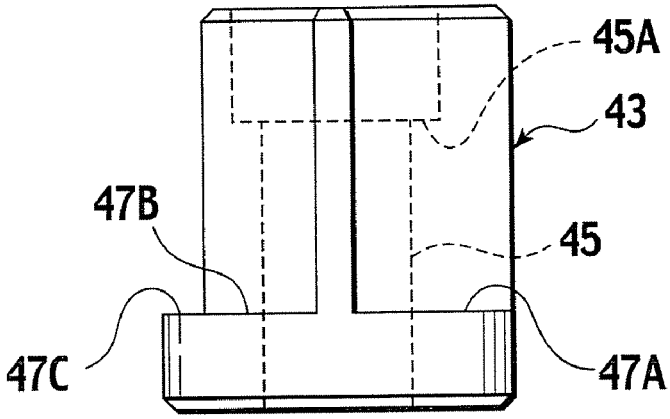

Notched portions 43A, 43B, and 43C which are formed by partially notching an outer peripheral face of the retainer 43 are formed at a plurality of portions of the outer peripheral face, and seat portions 47A, 47B, and 47C are formed on the lower portion of the retainer 43 according to the formation of the notched portions 43A, 43B, and 43C. In the retainer 43 provided on the small-diameter punch 23, the retainers 43 adjacent across the large-diameter punch 27 are formed in a symmetrical shape, as shown in FIG. 3.

As shown in FIG. 1, a small-diameter lifter spring 49 which always biases the small-diameter punch 23 upward to support the same at a predetermined height position in a normal state is resiliently mounted between the small-diameter punch 23 and the guide member 37. A strong stripper spring 51 for drawing out the small-diameter punch 23 upward after punching work to a workpiece (not shown) is resiliently mounted between the retainer 43 and the guide member 37.

The large-diameter punch 27 is fitted in the punch mounting hole 29 vertically movably, and both sides of a retainer 53 (see FIG. 3) provided on a punch head 52 of the large-diameter punch 27 are projectingly formed toward the retainer 43 side of the small-diameter punch 23 and supported by the seat portions 47A and 47C of the retainers 43 adjacent to each other. That is, both the stripper springs 51 for the small-diameter punches 23 adjacent to each other also serve as a stripper spring of the large-diameter punch 27.

Therefore, when the punching work to the workpiece is performed by the large-diameter punch 27, the large-diameter punch 27 is drawn out of the workpiece by the action of the stripper springs 51 on the both sides, so that a drawing force which is simply twice as large as a drawing force for the small-diameter punch 23 acts on the large-diameter punch 27.

As already understood, since the stripper springs 51 for the small-diameter punches 23 arranged approximately symmetrically on both sides of the large-diameter punch 27 also serve as stripper springs for the large-diameter punch 27, a bending moment due to an unbalanced load does not act on the large-diameter punch 27, so that a jamming phenomenon can be suppressed. Also, it is unnecessary to additionally provide a stripper spring for the large-diameter punch 27. Therefore, a diameter of the punch mounting hole 29 of the large-diameter punch 27 can be made approximately equal to a diameter of the large-diameter punch 27. Therefore, an arrangement of more punches becomes possible and small-sized entire configuration of the punch tool can be achieved.

A stripper spring 55 (see FIG. 1 and FIG. 3) for the medium-diameter punch 31 is arranged on an inner side beyond the punch mounting hole 33 of the medium-diameter punch 31 (a position nearer the axial center of the casing 17) in the punch mounting portion 19 of the casing 17, and a retainer 57 formed with a seat portion 57A is provided on an upper portion of the stripper spring 55. A punch head 59 provided on the medium-diameter punch 31 is supported on the seat portion 57A of the retainer 57 and the seat portion 47B of the retainer 43 provided on the small-diameter punch 23.

The seat portion 57A of the retainer 57 and the seat portion 47B of the retainer 43 of the small-diameter punch 23 support an approximately symmetrical positions of the punch head 59 in the medium-diameter punch 31. Therefore, when the medium-diameter punch 31 is drawn out of a workpiece after the punching work to the workpiece performed by the medium-diameter punch 31, a bending moment does not act on the medium-diameter punch 31, so that a jamming phenomenon can be suppressed.

As already understood, the stripper spring 51 for the small-diameter punch 23 also serves as a stripper spring of the medium-diameter punch 31. In other words, since the stripper spring 51 for the small-diameter punch 23 and the stripper spring 55 act on the medium-diameter punch 31, the stripper spring 55 can be downsized to the same extent as the stripper spring 51 for the small-diameter punch 23, so that the small-sized entire configuration of the punch tool can be achieved.

A disk-like ram guide 61 is mounted in the circular recess upper space 21 in the casing 17, and small rams 63 having a cross-sectional shape of an inverted T-shape corresponding to the punch heads of the respective punches 23, 27, and 31 are supported to be vertically movable on the ram guide 61. The small rams 63 serve as striking-force transmitting members which transmit striking forces to the respective punches 23, 27, and 31, when the small rams 63 are struck by strikers described below, and lower faces of the respective small rams 63 abut on the upper faces of the punch heads of the respective punches 23, 27, and 31 to which the respective small rams correspond. Column-shaped upper portions of the respective small rams 63 project upward from the ram guide 61, and the height positions of the upper faces of the respective small rams 63 are set to be approximately equal.

According to this configuration, even when the respective punches 23, 27, and 31 are arranged closely to one another, the small-diameter column-shaped upper portions of the respective small rams 63 can be arranged to be separated relatively largely from one another.

A guide flange 67 including a large circular recess portion 65 on its lower face central portion is integrally attached by fixing units such as a plurality of bolts on the flange 17F in the casing 17, and a driver guide 69 is supported, only relatively rotatably by a plurality of bearings 71 in a central portion of the guide flange 67. A punch driver 73 is supported to be vertically movable in the central portion of the driver guide 69, and a strong elastic member 77 such as a disc spring is resiliently mounted between a head plate 75 attached on an upper end portion of the punch driver 73 projecting upward from the driver guide 69 and a flange 69F provided on the driver guide 69.

The punch driver 73 is restricted so as not to rotate relative to the driver guide 69 and supported to be movable only vertically, and a key groove 79 (see FIG. 2) extending in a vertical direction is formed on a portion of the punch driver 73 in order to restrict relative rotations. A key 81 engaged with the key groove 79 is fixed on a portion of the driver guide 69.

In order to restrict rotations of the driver guide 69, a key supporting member 85 including a key 83 is attached integrally on the flange portion 69F. The key 83 is engaged with a key groove 7K, extending in a vertical direction, formed on the inner face of the lifter ring 7 to be vertically movable.

A large-diameter flange portion 73F positioned in the recess portion 65 of the guide flange 67 is formed on a lower portion of the punch driver 73. An outside striker 87 striking (driving) the small-diameter punch 23 and the large-diameter punch 27 arranged on the outside circle L1 is provided at a predetermined position of a lower face of the flange portion 73F, and an inside striker 89 striking (driving) the medium-diameter punch 31 arranged on the inside circle L2 is provided at a predetermined position thereof.

The strikers 87 and 89 cause respective punches corresponding to respective small rams 63 to descend by striking upper end faces of the respective small rams 63 individually, and the outside striker 87 and the inside striker 89 are arranged on a line in a diametrical direction (in a radial direction). That is, when the outside striker 87 is located at a position where the outside striker 87 strikes the small ram 63 corresponding to the small-diameter punch 23 and the large-diameter punch 27, the inside striker 89 is located at a position deviated in a circumferential direction of the inside circle L2 from the small ram 63 corresponding to the medium-diameter punch 31. On the contrary, when the inside striker 89 is located at a position where the inside striker 89 strikes the small ram 63 corresponding to the medium-diameter punch 31, the outside striker 87 is located at a position between the small rams 63 corresponding to the small-diameter punch 23 and the large-diameter punch 27. It is also possible to integrate the outside striker 87 and the inside striker 89 to make a striker that is long in a radial direction.

A die 91 corresponding to the punch tool 1 described above to perform the punching work to a plate-like workpiece includes die holes (not shown) corresponding to the respective punches 23, 27 and 31, and supported by a rotating holder 95 provided rotatably in a die holder 93 provided opposite to the punch holder 3. The rotating holder 95 is provided to rotate in synchronization with the rotating holder 5. Since a synchronization rotation mechanism for rotating the lower rotating holder 95 in synchronization with the upper rotating holder 5 and a configuration of the die 91 are heretofore known, detailed explanations of the synchronization rotation mechanism and the configuration of the die 91 and the like will be omitted.

In the configuration described above, when the rotating holder 5 is rotated horizontally, the casing 17 supported in the rotating holder 5 is also rotated integrally. On the other hand, since the lifter ring 7, the driver guide 69, and the punch driver 73 are in a state that rotations thereof are restricted, the small-diameter punch 23, the large-diameter punch 27 and the medium-diameter punch 31 can be indexed and positioned below the strikers 87 and 89 provided on the lower face of the punch driver 73.

As shown in FIG. 1, when a ram R provided on the punch press to be vertically movable descends to press the head plate 75 downward (to press in a downward direction) after the small-diameter punch 23 is indexed and positioned at a position below the striker 87, the lifter ring 7 descends against the lifter spring 11 via the elastic member 77. Therefore, the entirety of the punch tool 1 descends.

As described above, when the entirety of the punch tool 1 descends and the stripper plate 39 abuts on a workpiece W on the die 91, descent of the punch tool 1 is stopped. Thereafter, when the ram R further descends, the elastic member 77 is compressed gradually, and the stripper plate 39 presses and fixes the workpiece W gradually strongly to the die 91 due to a repulsive force of the elastic member 77.

When the striker 87 provided on the punch driver 73 abuts on the small ram 63 corresponding to the small-diameter punch 23 to press the small ram 63 downward by further descending of the ram R in a state that the workpiece W is pressed and fixed, the small-diameter punch 23 descends against biasing forces of the lifter spring 49 and the stripper spring 51 to perform the punching work to the workpiece W in cooperation with the die 91.

Thereafter, when the ram R ascends, the small-diameter punch 23 is drawn out of the workpiece W by the action of the stripper spring 51 and caused to ascend and return to the original position, and the punch driver 73 is caused to ascend and return by the action of the elastic member 77. The lifter ring 7 and the entirety of the punch tool 1 are caused to return to the original ascending positions by the action of the lifter spring 11. That is, the lifter ring 7 and the entirety of the punch tool 1 return to the initial state.

Next, the punching work is performed on the workpiece W using the large-diameter punch 27 by performing an operation similar to that described above after the large-diameter punch 27 is indexed and positioned at a position below the striker 87. At this time, when the large-diameter punch 27 descends, the retainers 43 provided on the small-diameter punches 23 positioned on both sides of the large-diameter punch 27 are caused to descend by the retainer 53 provided on the large-diameter punch 27, and the stripper springs 51 corresponding to the small-diameter punches 23 on the both sides are compressed. However, since each small-diameter punch 23 is supported at a predetermined height position by the lifter spring 49, each small-diameter punch 23 does not contact the upper face of the workpiece W.

Since the stripper springs 51 for the small-diameter punches 23 positioned on the both sides of operates when the large-diameter punch 27 is drawn out of the workpiece W, a force which is twice as large as a force in the case that the small-diameter punch 23 is drawn out of the workpiece acts, so that a large drawing force acts on the large-diameter punch 27. At this time, since the stripper springs 51 on the both sides act on the large-diameter punch 27 at approximately symmetrical positions, a bending moment or the like does not act on the large-diameter punch 27, and a jamming phenomenon does not occur on a sliding portion. When the medium-diameter punch 31 is indexed and positioned at a position below the inside striker 89 to perform the punching work to the workpiece, an effect similar to that in the case of the large-diameter punch 27 can be also achieved.

As understood from the above explanation, according to the punch tool 1 of the present embodiment, since the stripper springs for the small-diameter punches arranged on the both sides of the large-diameter punch also serve as stripper springs for the large-diameter punch, a bending moment that acts on the large-diameter punch can be suppressed, so that a jamming phenomenon of the sliding portion can be eliminated, arrangement of more punches becomes possible, and the small-sized punch tool can be achieved.

Since punches are arranged on the outside large-diameter circle and the inside small-diameter circle, respectively, and the punches on the outside circle and the punches on the inside circle are arranged at different phases, downsizing of the entire configuration and compactedness of the punch tool can be achieved by arranging the outside circle and the inside circle closely, and more punches can be arranged.

Further, since there is a configuration in which the small ram serving as a striking-force transmitting member for transmitting a striking force of the striker to each punch is provided to be vertically movable on the upper portion of each punch, only a punch positioned just below the striker is operated without operating adjacent punches even when the retainers provided on respective punches are arranged closely so as to interfere with one another.

The embodiment of the present invention described above is to be considered not restrictive, and the invention can be embodied in other various forms, as changes are appropriately made.

Note that the disclosure of Japanese Patent Application No. 2004-187880 (filed on Jun. 25, 2004) is incorporated by reference herein in their entirety.

The invention claimed is:

1. A punch tool, comprising:

a casing;

a plurality of small-diameter punches vertically movable and circularly arranged in the casing;

a plurality of large-diameter punches vertically movable and circularly arranged in the casing;

a punch driver provided to be vertically movable and relatively rotatable on an upper portion of the casing;

a striker provided on the punch driver to be capable of striking the respective punches; and stripper springs corresponding to the respective small-diameter punches, each said small-diameter punch having a respective stripper spring positioned therearound with said small-diameter punch extending through the center of the respective stripper spring;

wherein the respective large-diameter punches are arranged between the small-diameter punches, thereby the stripper springs for the small-diameter punches on both sides of the large-diameter punch act as stripper springs for the large-diameter punch;

wherein the stripper springs provided corresponding to the respective small-diameter punches act as stripper springs of the large-diameter punch and a medium-diameter punch;

wherein a retainer is provided on the small-diameter punch;

wherein another retainer is provided on the large-diameter punch; and wherein a seat portion that supports the retainer provided on the large-diameter punch is provided on the retainer provided on the small diameter punch.

2. The punch tool according to claim 1, wherein striking-force transmitting members for transmitting striking forces of the strikers to the respective punches is provided to be vertically movable on the upper portions of the respective punches.

* * * * *